US008800315B2

(12) United States Patent
Kim et al.

(10) Patent No.: US 8,800,315 B2
(45) Date of Patent: Aug. 12, 2014

(54) REFRIGERATOR

(75) Inventors: Yonghyun Kim, Gyeongsangnam-do (KR); Ilwook Joung, Gyeongsangnam-do (KR); Siyeon An, Gyeongsangnam-do (KR); Byoungjun Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 168 days.

(21) Appl. No.: 13/181,553

(22) Filed: Jul. 13, 2011

(65) Prior Publication Data

US 2012/0011877 A1 Jan. 19, 2012

(30) Foreign Application Priority Data

Jul. 14, 2010 (KR) ..... 10-2010-0067828

(51) Int. Cl.
*F25C 1/00* (2006.01)

(52) U.S. Cl.
USPC ..... 62/347; 62/74; 62/339

(58) Field of Classification Search
USPC ..... 62/66, 74, 344, 347, 391, 398, 337, 62/338, 339
See application file for complete search history.

(56) References Cited

U.S. PATENT DOCUMENTS

| | | | | |
|---|---|---|---|---|
| 5,090,208 | A * | 2/1992 | Aono et al. | 62/347 |
| 5,904,054 | A * | 5/1999 | Lee | 62/347 |
| 6,574,982 | B1 * | 6/2003 | Wiseman et al. | 62/347 |
| 7,490,475 | B2 * | 2/2009 | Kim et al. | 62/74 |
| 7,568,354 | B2 * | 8/2009 | Coulter et al. | 62/74 |
| 8,371,138 | B2 | 2/2013 | Choi | |
| 2009/0314012 | A1 * | 12/2009 | Lim et al. | 62/66 |
| 2009/0314024 | A1 * | 12/2009 | Choi | 62/347 |
| 2010/0083685 | A1 * | 4/2010 | Kim et al. | 62/347 |
| 2010/0147011 | A1 * | 6/2010 | Kang et al. | 62/344 |

FOREIGN PATENT DOCUMENTS

| | | | |
|---|---|---|---|
| CN | 1282863 | A | 2/2001 |
| CN | 2543002 | Y | 4/2003 |
| CN | 1431442 | A | 7/2003 |
| CN | 101523137 | A | 9/2009 |
| JP | 09-105572 | A | 4/1997 |
| JP | 2005-257144 | A | 9/2005 |

OTHER PUBLICATIONS

Chinese Office Action and Search Report dated Jun. 9, 2013 for Application No. 201110232819.7, with English Translation, 13 pages.

* cited by examiner

*Primary Examiner* — Allana Lewin
*Assistant Examiner* — Kun Kai Ma
(74) *Attorney, Agent, or Firm* — Fish & Richardson P.C.

(57) ABSTRACT

Provided is a refrigerator. In the refrigerator, a water supply unit connected to a water supply passage to temporarily store the supplied water, thereby stably supplying water is disposed above an ice making apparatus. Also, since water having a reduced pressure is supplied into the ice making apparatus, the water may be stably supplied into the ice making apparatus.

9 Claims, 9 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2010-0067828 (Jul. 14, 2010), which is hereby incorporated by reference in its entirety.

BACKGROUND

Embodiments relate to a refrigerator.

A refrigerator is a home appliance providing a low-temperature storage that can be opened and closed by a door for storing foods at a low temperature. For this, the refrigerator cools the inside of the storage space using cool air generated by heat-exchanging with a refrigerant that circulates a cooling cycle to store the foods in an optimum state.

The size of the refrigerator tends to increase more and more and multi-functions are provided to the refrigerator as dietary life changes and pursues high quality, and accordingly, refrigerators of various structures with consideration of user convenience and energy efficiency are brought to the market.

Specifically, a refrigerator including an ice making apparatus in which water is automatically supplied to make ices is becoming popular these days. In this case, water within a water tank or a water supply source such as a water pipe is supplied into the ice making apparatus of the refrigerator to make ices. Here, when the water supplied into the ice making apparatus has a high pressure, the water may be spattered to tangle the stored ices with each other in the ice making apparatus. As a result, the ice making performance and quality of the ice making apparatus may be deteriorated.

SUMMARY

In one embodiment, a refrigerator includes: a cabinet defining a storage space which is opened or closed by a door; an ice making apparatus disposed inside the storage space; a water supply passage extending from a water supply source toward the ice making apparatus; and a water supply unit disposed above the ice making apparatus, the water supply unit having a sectional area greater than that of the water supply passage so that the water supply unit is connected to the water supply passage to temporarily receive water supplied through the water supply passage.

The water supply unit may be mounted on an outer top surface of the cabinet.

The water supply unit may be mounted to so that a top surface thereof is exposed to an outer case defining an outer appearance of the cabinet.

The water supply unit may be buried into an insulation material filled into the cabinet.

The water supply unit may be exposed to the outside of the refrigerator through the top surface of the cabinet.

The water supply unit may be mounted inside the storage space.

The water supply unit may be disposed on the door for opening or closing the storage space.

The water supply unit may be disposed on a barrier for partitioning the storage space.

The water supply source may be at least one of a water pipe disposed outside the refrigerator or a water tank detachably disposed inside the refrigerator.

A flow direction of water supplied into the water supply unit may cross that of water supplied outside the water supply unit.

The water supply unit may include: a case mounted on the cabinet; and a fill tank disposed inside the case, the fill tank providing an expanded space than a space within the water supply passage to temporarily receive the supplied water.

The refrigerator may further include a guide tube disposed in the fill tank to extend toward the inside of the refrigerator, thereby guiding water to the ice making apparatus.

The case may include: a case body disposed on the cabinet, the case body receiving the fill tank; and a case cover opening or closing an opened surface of the case body, the case cover being exposed to the outside of the refrigerator.

At least one portion of an inner surface of the water supply unit may be curved so that the supplied water is supplied into the ice making apparatus while being rotated along the inner surface of the water supply unit.

At least one portion of an inner surface of the water supply unit may be inclined so that the supplied water is supplied into the ice making apparatus while being moved along the inclined inside surface of the water supply unit.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
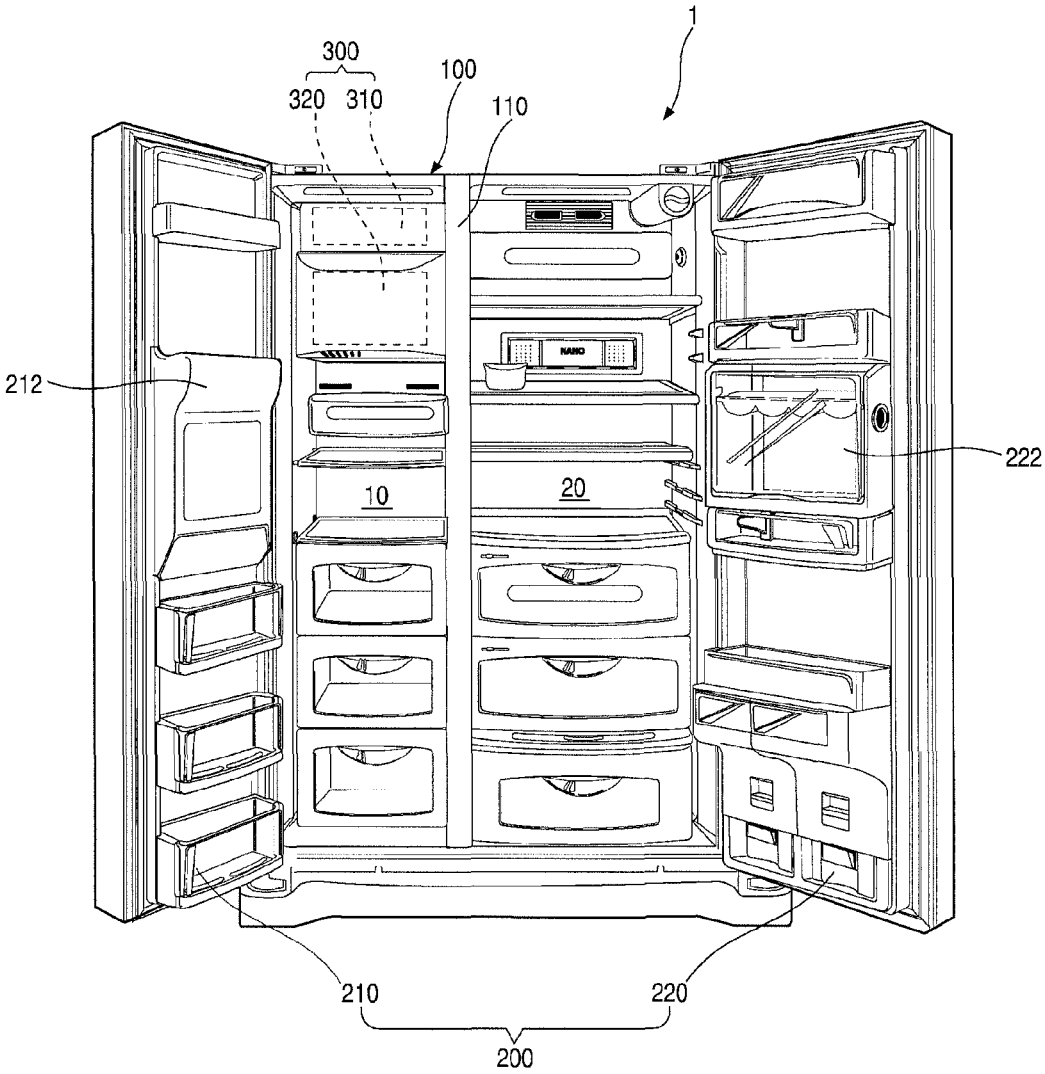
FIG. 1 is a view of a refrigerator with a door opened according to an embodiment.

FIG. 1 is a view of a refrigerator with a door opened according to an embodiment.

Referring to FIG. 1, a refrigerator 1 according to an embodiment includes a cabinet 100 defining a storage space and a door 200 which is openable or closable on the cabinet 100. An outer appearance of the refrigerator may be defined by the cabinet 100 and the door 200.

The inside of the cabinet 100 is partitioned into left and right sides by a barrier 110. A freezing compartment 10 is defined at the left side of the cabinet 100, and a refrigerating compartment 20 is defined at the right side of the cabinet 100. A plurality of shelves and drawers are disposed inside the freezing compartment 20 and the refrigerating compartment 10 to receive foods.

An ice making apparatus 300 is disposed inside the freezing compartment 10. The ice making apparatus 300 is configured to make and store an ice. The ice making apparatus 300 includes an ice tray 310 in which ices are made and an ice bank disposed under the ice tray 310 to store the made ices.

Each of the ice tray 310 and the ice bank 320 which constitute the ice making apparatus 300 may have various shapes according to a shape of the ice making apparatus 300. The ice making apparatus 300 may be disposed in a freezing compartment door 210 except the freezing compartment 10. As necessary, the ice making apparatus 300 may be disposed inside an ice making chamber having an independent insulating space in the refrigerating compartment 20 or a refrigerating compartment door 220.

The door 200 may include the freezing compartment door 210 and the refrigerating compartment door 220 which respectively open or close the refrigerating compartment 20 and the freezing compartment 10. The freezing compartment door 210 and the refrigerating compartment door 220 are rotatably disposed on the cabinet 100 to open or close the refrigerating compartment 20 and the freezing compartment 10.

A home bar 222 disposed on the outside of the refrigerating compartment door 220 to define an openable receiving space may be disposed on the refrigerating compartment door 220. Also, a dispenser (not shown) may be disposed in the freezing compartment door 210 to dispense purified water or ices made in the ice making apparatus 300 to the outside. An ice chute 212 may be disposed on the freezing compartment door 210 to allow the ice making apparatus 300 to communicate with the dispenser in a state where the freezing compartment door 210 is closed.

Figure 2:
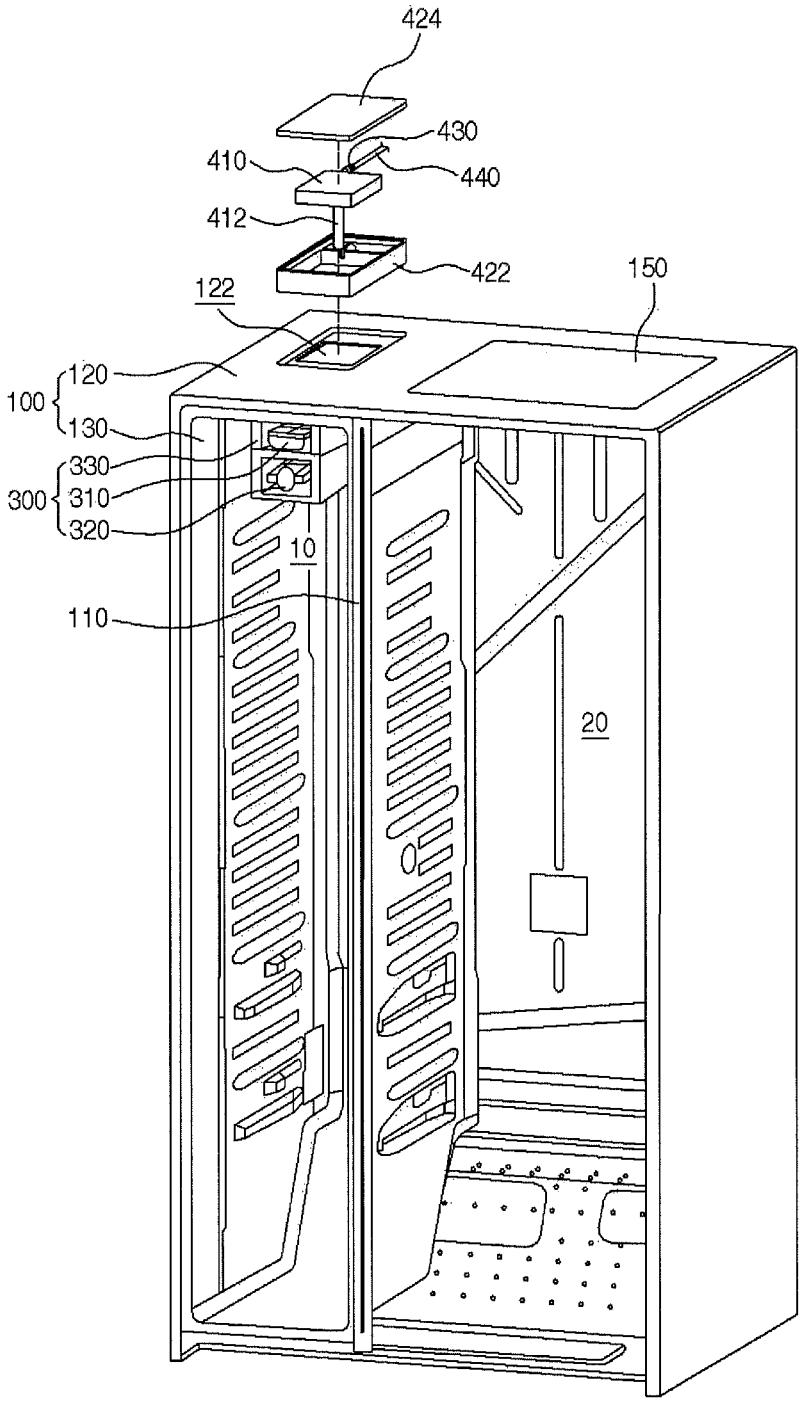
FIG. 2 is a partially perspective view illustrating an upper portion of a cabinet according to an embodiment.
Figure 3:
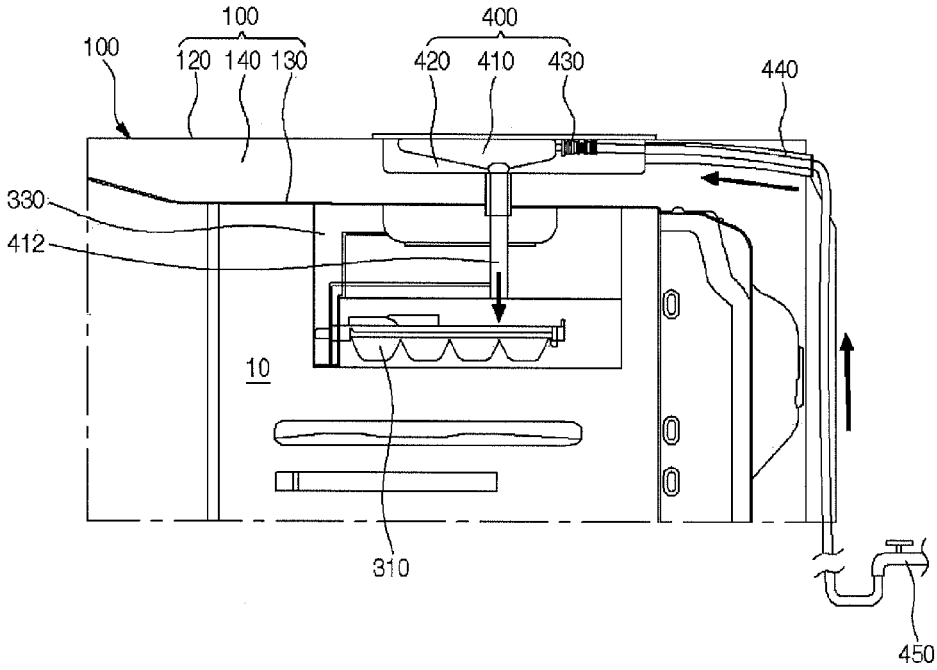
FIG. 3 is a partially schematic sectional view illustrating a structure of the upper portion of the cabinet.
Figure 4:
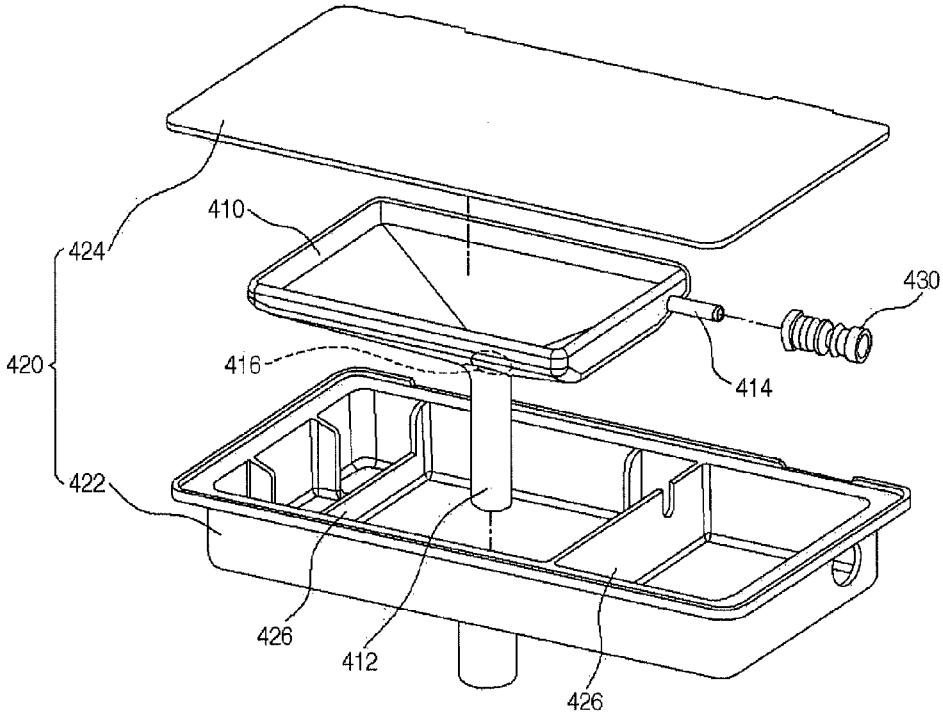
FIG. 4 is an exploded perspective view illustrating a structure of a water supply unit according to an embodiment.

FIG. 2 is a partially perspective view illustrating an upper portion of a cabinet according to an embodiment. FIG. 3 is a partially schematic sectional view illustrating a structure of the upper portion of the cabinet. FIG. 4 is an exploded perspective view illustrating a structure of a water supply unit according to an embodiment.

Referring to FIGS. 2 to 4, the cabinet 100 has a hexahedral shape with a front surface opened. Also, the cabinet 100 includes an outer case 120 defining an outer appearance thereof and an inner case 130 coupled to the outer case 120 to define the storage space. An insulation material 140 is foamed and filled into a space between the outer case 120 and the inner case 130.

A main control unit 150 is disposed on a top surface of the cabinet 100. The main control unit 150 includes a main printed circuit board (PCB) for operating the refrigerator. The main control unit 150 protrudes upward from the top surface of the cabinet 100.

Also, a water supply unit 400 is disposed on the top surface of the cabinet 100. The water supply unit 400 may be disposed directly above the ice making apparatus 300. Thus, the water supply unit 400 is disposed on the top surface of the cabinet 100 at a side of the freezing compartment 10. A water supply unit mounting part 122 may be which is recessed downward may be defined in the top surface of the cabinet 100 corresponding to the mounted position of the ice making apparatus 300 to mount the water supply unit 400.

The ice making apparatus 300 may include the ice tray 310, the ice bank 320, and a frame 330. The frame 330 fixes the ice tray 310 or the ice tray 310 and the ice bank 320. The frame 330 is fixedly mounted on a top surface of the inside of the freezing compartment 10. The frame 330 is disposed on a position corresponding to that of the water supply unit mounting part 122. Also, the ice tray 310 may be easily accessible through the frame 330.

A water supply passage 440 may be connected to a water supply source 450 such as a water pipe disposed outside the refrigerator or may be connected to the water supply unit 400 through a back surface of the cabinet 100. Here, a portion of the water supply passage 440 is exposed to the outside, and the remaining portion of the water supply passage 440 is buried into the insulation material 140. A water tank disposed within the refrigerator may be used as the water supply source 450. The water supply passage 440 may be disposed inside the refrigerator to connect the water supply source 450 to the water supply unit 400.

The water supply unit 400 may include a fill tank 410 into which water is supplied, a water supply unit case 420 for receiving the fill tank 410, and a tube connector 430 connecting the fill tank 410 to the water supply unit 400.

The fill tank 410 defines a space into which water supplied through the water supply passage 440 is introduced. The fill tank 410 may have an inner sectional area greater than a sectional area of the water supply passage 440. Thus, when water having a high pressure is introduced into the fill tank 410, the inside of the fill tank 410 may be decreased in pressure. The fill tank 410 may seal portions remaining except a guide tube 412 and a connection tube 414. Also, the fill tank 410 has a predetermined volume.

The guide tube 412 is disposed on a bottom surface of the fill tank 410 to extend downward so that water within the fill tank 410 is supplied into the ice tray 310. The guide tube 412 vertically extends downward toward the ice tray 310.

The guide tube 412 may be integrally formed when the fill tank 410 is formed. The guide tube 412 may be mounted at a side of the fill tank 410. The connection tube 414 extends outward and is connected to the water supply passage 440 through the tube connector 430.

The fill tank 410 may have a rounded inner surface so that water introduced through the connection tune 414 is moved while being rotated. Also, a bottom surface of the fill tank 410 may be inclined downward. In addition, the bottom surface of the fill tank 410 may be inclined toward a water discharge hole 416 corresponding to an upper end of the guide tube 412.

Thus, the high-pressure water introduced through the connection tube 414 may be decreased in flow rate and pressure while being moved along an inner wall of the fill tank 410. Also, the water may be moved along the inclined bottom surface of the fill tank 410 and then discharged through the water discharge hole 416.

The water supply unit case 420 is mounted on the water supply unit mounting part 122. The water supply unit case 420 includes a case body 422 defining a space in which the fill tank 410 is received and a case cover 424 for opening or closing an opened top surface of the case body.

A fixing part 426 on which the fill tank 410 is fixedly mounted is disposed inside the case body 422. The fill tank 410 may be maintained in a state in which it 410 is fixed to the inside of the water supply unit case 420 by the fixing part 426. A space for receiving the tube connector 430 may be defined inside the case body 422. Thus, the water supply passage 440 and the fill tank 410 may be connected to each other inside the water supply unit case 420 by the tube connector 430.

The case cover 424 may open or close the case body 422. In a state where the case cover 424 is closed, the case cover 424 may be flush with the outer case 120.

The case body 422 may be assembled with the outer case 120 and then fixedly mounted. Also, the case body 422 may contact a portion of the insulation material 140 disposed inside the cabinet and then be fixedly mounted.

Hereinafter, a water supply process of the refrigerator according to an embodiment will be described in detail with reference to the accompanying drawings.

Figure 5:
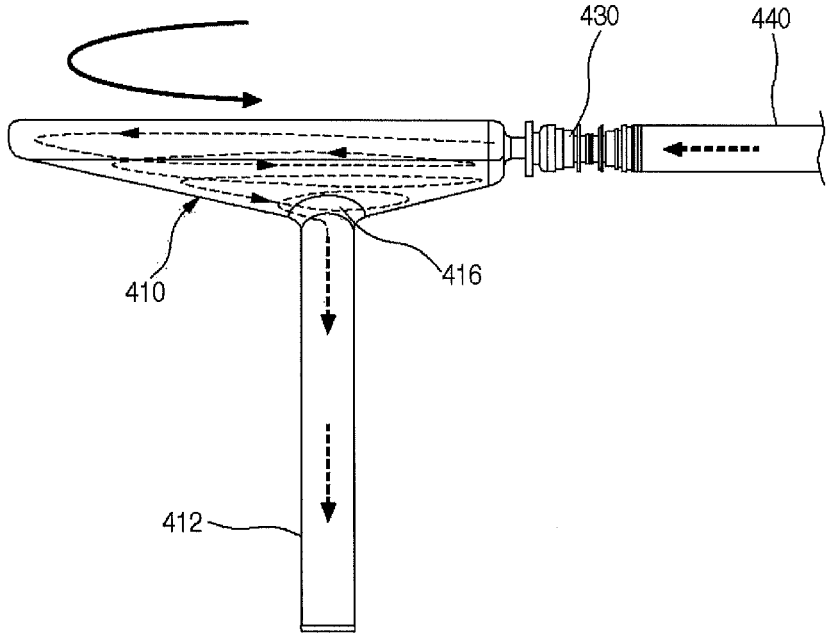
FIG. 5 is a view illustrating a flow state of water in the water supply unit.

FIG. 5 is a view illustrating a flow state of water in the water supply unit.

Referring to FIGS. 3 to 5, when a water supply signal for making an ice is transmitted, water is supplied through the water supply passage 440 connected to the water supply source 450. In case where a water pipe is used as the water supply source 450, water is supplied up to the water supply unit 400 by its water pressure. When a pump (not shown) is provided on the water supply passage 440, water is supplied through the water supply passage 440 by an operation of the pump.

The water supplied through the water supply passage 440 connected to the water supply unit 400 is supplied into the fill tank 410 through the connection tube 414. Here, the fill tank 410 may have an inner space greater than that of the water supply passage 440. Thus, the inflowing water may be decreased in flow rate and water pressure.

The water introduced into the fill tank 410 is rotated along the inner surface of the fill tank 410 and moved downward along the bottom surface of the fill tank 410 inclined downward. Then, the water is introduced into the guide tube 412 through the water discharge hole 416 defined in the bottom surface of the fill tank 410.

The water within the fill tank 410 is supplied into the ice making apparatus 300 through the guide tube 412. A lower end of the guide tube 412 may be disposed above the ice tray 310, and water supplied from the guide tube 412 may be filled into the ice tray 310 at a predetermined rate.

The water introduced into the fill tank 410 is vertically moved downward through the guide tube 412 while being filled into the fill tank 410. Here, the water within the fill tank 410 drops down by a self-weight. If the fill tank 410 is not completely filled, the water is discharged at a pressure less than that of the water supply passage 440.

Since the water dropping down through the guide tube 412 is not affected by a pressure of the introduced water, the water may be supplied into the ice tray 310 at a uniform pressure and flow rate always. Thus, it may prevent the water from being spattered or locally supplied.

In addition to the foregoing embodiment, a refrigerator according to various embodiments may exemplified. Hereinafter, a refrigerator according to another embodiment will be described.

In the refrigerator according to another embodiment, a fill tank constituting a water supply unit has a circular shape so that water smoothly flows inside the fill tank.

Thus, according to another embodiment, the parts except for the water supply unit are the same as those of the foregoing embodiments, and thus descriptions thereof will be omitted. Also, like reference numeral denote like elements.

Figure 6:
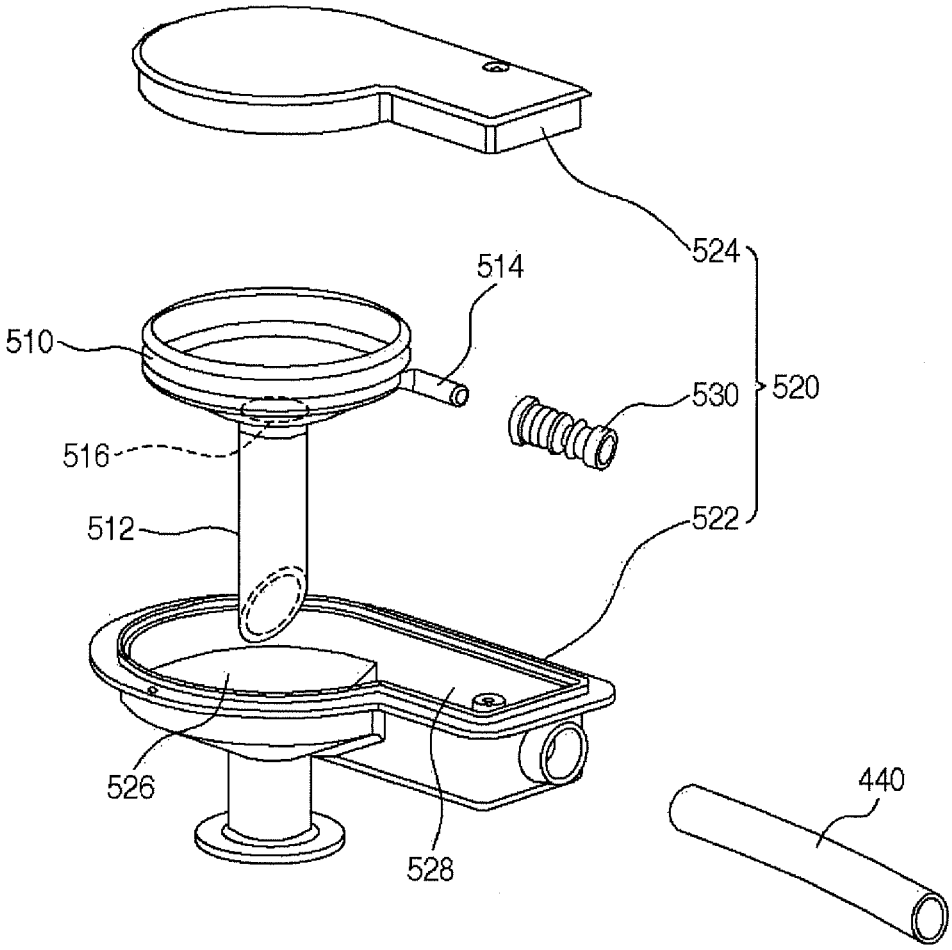
FIG. 6 is an exploded perspective view illustrating a structure of a water supply unit according to another embodiment.
Figure 7:
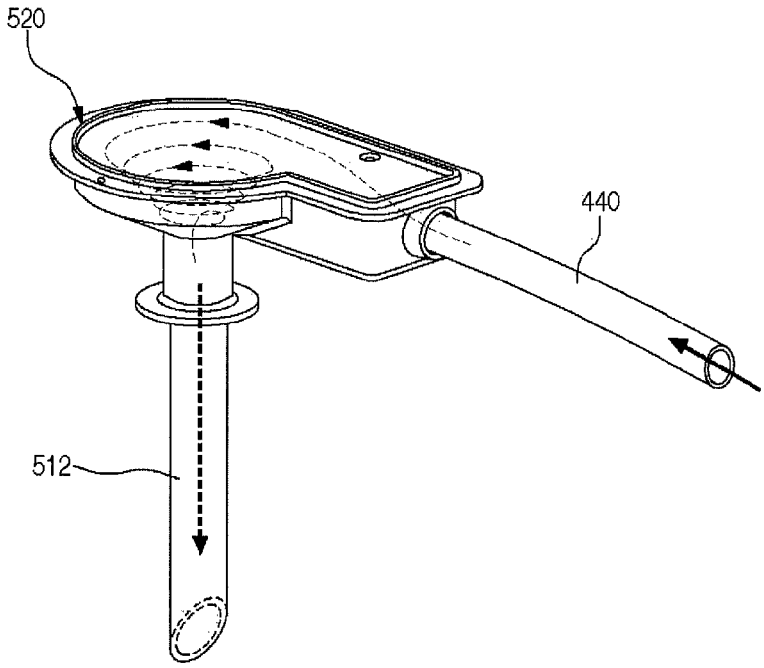
FIG. 7 is a view illustrating a flow state of water in the water supply unit.

FIG. 6 is an exploded perspective view illustrating a structure of a water supply unit according to another embodiment. FIG. 7 is a view illustrating a flow state of water in the water supply unit.

Referring to FIGS. 6 and 7, a water supply unit 500 according to another embodiment includes a fill tank 510 into which water is supplied from a water supply passage 540, a water supply unit case 520 for receiving the fill tank 510, and a tube connector 530 connecting the water supply passage 540 to the fill tank 510.

In detail, the fill tank 510 may have an expanded space than an inner space of the water supply passage 540. Thus, the water supplied through the water supply passage 540 may be reduced in pressure within the fill tank 510.

The fill tank 510 has a circular sectional shape. Thus, when water is supplied through a connection tube 514 disposed on a side of the fill tank 510, the water may be moved along a wall of the fill tank 510. Here, since the fill tank 510 has the circular sectional shape, the water may be moved along the inner wall of the fill tank 510 by its inflow pressure.

The fill tank 510 is inclined toward a water discharge hole 516 defined in a bottom surface thereof. Thus, the water introduced through the connection tube 514 flows spirally along the inner surface of the fill tank 510 and then flows toward the water discharge hole 516. The water inflowing into the water discharge hole 516 is supplied into the ice tray 310 through the guide tube 512 which extends downward.

The water supply unit case 520 may include a case body 522 defining a space in which the fill tank 510 is received and a case cover 524 for opening or closing an opened top surface of the case body. The water supply unit case 520 may include a fill tank receiving part 526 having a shape corresponding to that of the fill tank 510 and a connector part on which the tube connector 530 is disposed and protruding from the fill tank receiving part 526. Thus, the water supply passage 540 and the fill tank 514 may be connected to each other inside the connector part 528 by the tube connector 530.

A refrigerator according to various other embodiments may be exemplified. Hereinafter, a refrigerator according to another embodiment will be described.

In the refrigerator according to another embodiment, a water supply unit is mounted inside a storage space.

Thus, according to another embodiment, the parts except for the water supply unit are the same as those of the foregoing embodiments, and thus descriptions thereof will be omitted. Also, like reference numeral denote like elements.

Figure 8:
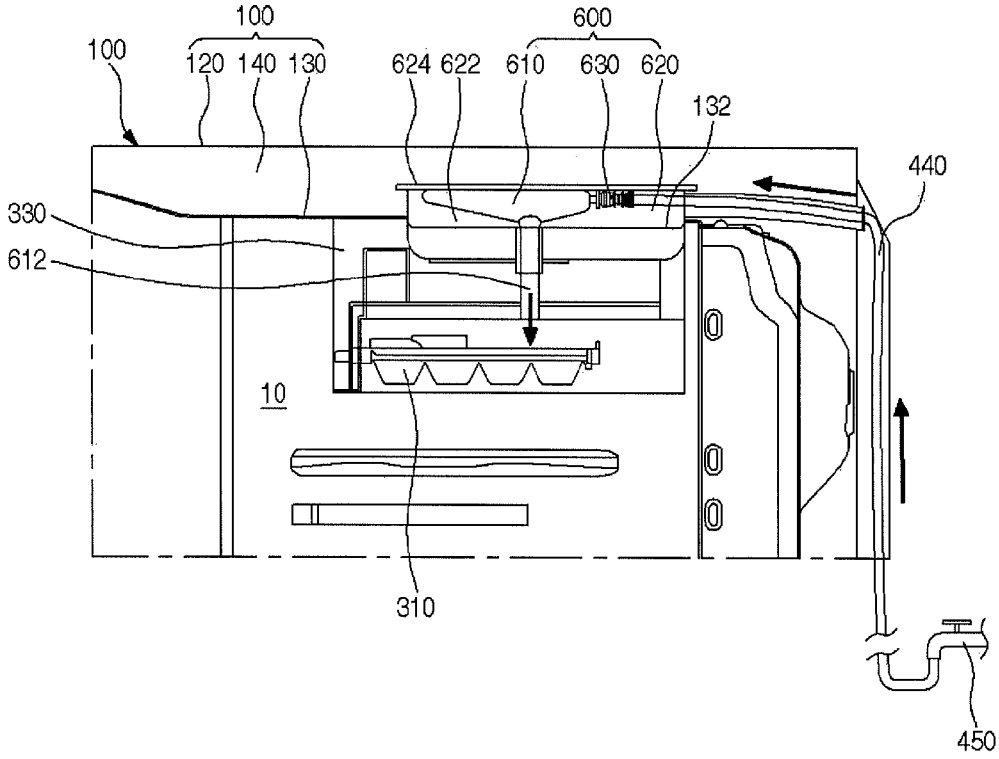
FIG. 8 is a sectional view illustrating a structure of an upper portion of a cabinet according to another embodiment.

FIG. 8 is a sectional view illustrating a structure of an upper portion of a cabinet according to another embodiment.

Referring to FIG. 8, a cabinet 100 according to another embodiment include an outer case 120, an inner case 130, and an insulation material 140. A water supply unit mounting part 132 which is recessed upward is defined in a top surface of the inside of the inner case 130.

A water supply unit 600 includes a fill tank 610 connected to the water supply passage 440 to receive water, a water supply unit case 620 for receiving the fill tank 610, and a tube connector 630 connecting the water supply passage 440 to the fill tank 610.

The water supply unit case 620 may include a case body defining a space for receiving the fill tank 610 and a case cover 624 for covering an opened bottom surface of the case body 622. The case body 622 is fixedly mounted on the water supply unit mounting part 132. The case cover 624 may be openably disposed inside the storage space and exposed to a side of the inside of the refrigerator. In a state where the case cover 624 is closed, the case cover 624 may be flush with the inner case 130.

The water supply unit 600 has the same inner structure as that of the water supply unit 400 according to the foregoing embodiments except that it is mounted on the inner case 130.

The water supply passage 440 passes through a cabinet 100 from a rear side toward the inside of the cabinet 100. Also, the water supply unit 440 is connected to the water supply unit 600. Also, the water supply passage 440 is buried within and fixed to an insulation material 140.

Thus, water supplied through the water supply passage 440 may be stably supplied into an ice tray 310 inside a freezing compartment 10 through a guide tube 612 after a pressure thereof is reduced inside the fill tank 610 of the water supply unit 600.

A refrigerator according to various other embodiments may be exemplified. Hereinafter, a refrigerator according to another embodiment will be described.

In the refrigerator according to another embodiment, an ice making apparatus and a water supply unit are disposed in a refrigerating compartment door.

Figure 9:
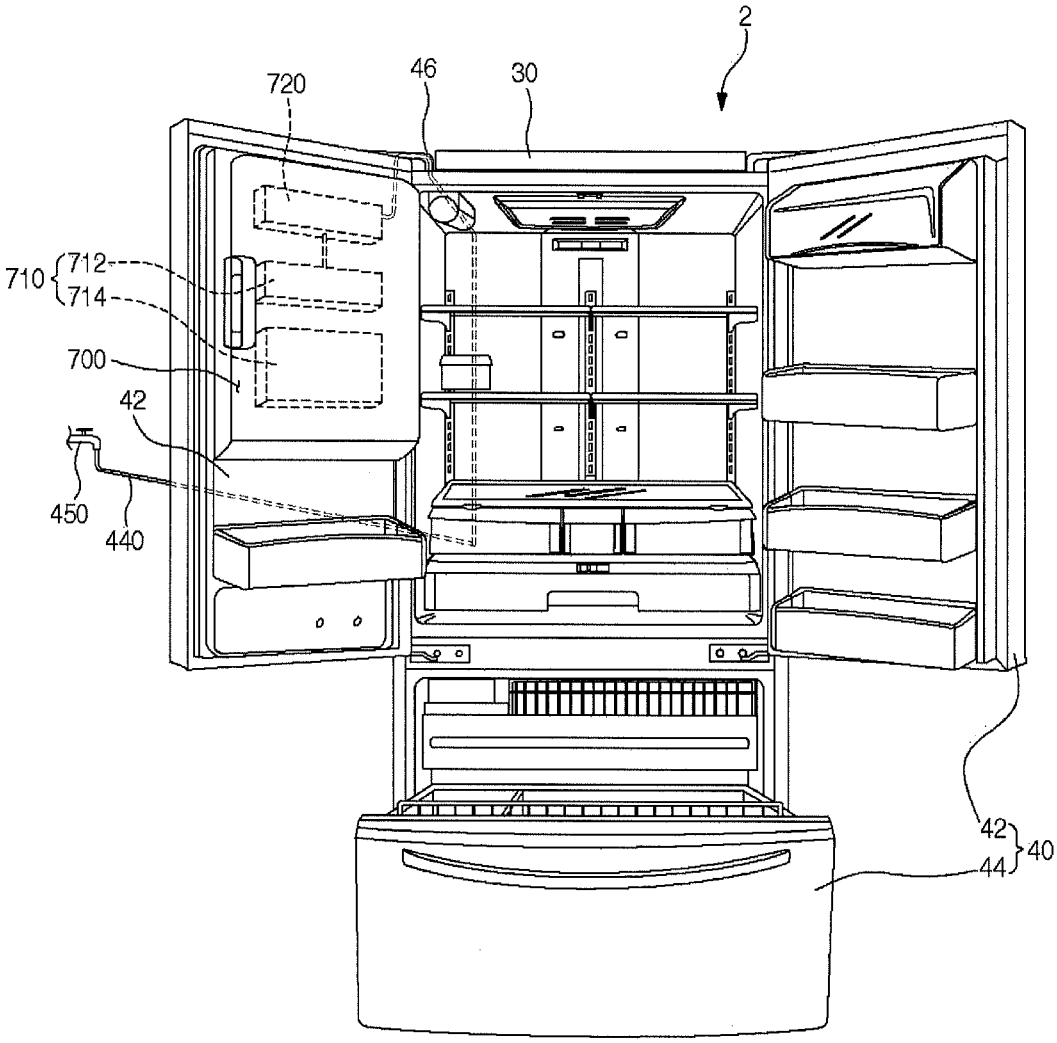
FIG. 9 is a view of a refrigerator with a door opened according to another embodiment.

FIG. 9 is a view of a refrigerator with a door opened according to another embodiment.

Referring to FIG. 9, a refrigerator 2 according to another embodiment includes a cabinet 30 defining a storage space and a door for opening/closing the storage space. Here, an outer appearance of the refrigerator 2 is defined by the cabinet 30 and the door.

Also, the storage space inside the cabinet 30 is vertically partitioned to define a refrigerating compartment 32 at an upper side and a freezing compartment at a lower side. The door 40 may include a refrigerating compartment door 42 for covering the refrigerating compartment 32 and a freezing compartment door 44 for covering the freezing compartment 34.

The refrigerating compartment door 42 is coupled to the cabinet 30 by a hinge 46. Thus, a pair of doors may be rotatably mounted on the cabinet 30. An ice making chamber 700 that is an independent insulation space may be defined in the refrigerating compartment door 42. The ice making chamber 700 provides a space in which ices are mode and stored. Cool air supplied from the freeing compartment 34 or an evaporator may be guided to the ice making chamber 700 by a duct.

An ice making apparatus 710 for making ices is disposed inside the ice making chamber 700. The ice making apparatus 710 may include an ice maker 712 for making ices and an ice bank 714 for storing the made ices.

A water supply unit 720 for supplying water into the ice maker 712 is disposed above the ice maker 712. The water supply unit 720 is connected to a water supply passage 440. Since the water supply unit 720 has the same inner structure as that of the water supply unit 400 according to the foregoing embodiments, their detailed description will be omitted.

The water supply unit 720 may be disposed above the ice making chamber 700. Also, at least one portion of the water supply unit 720 may be buried into the refrigerating compartment door 42 or the insulation material of the ice making chamber 700 to prevent the water from being frozen. Then, the water supply passage 440 is guided to the refrigerating compartment door 42 through the hinge 46. Thus, the water supply passage 440 may be connected to the water supply unit 720.

A refrigerator according to various other embodiments may be exemplified. Hereinafter, a refrigerator according to another embodiment will be described.

In the refrigerator according to another embodiment, a water supply unit is mounted on a barrier.

Figure 10:
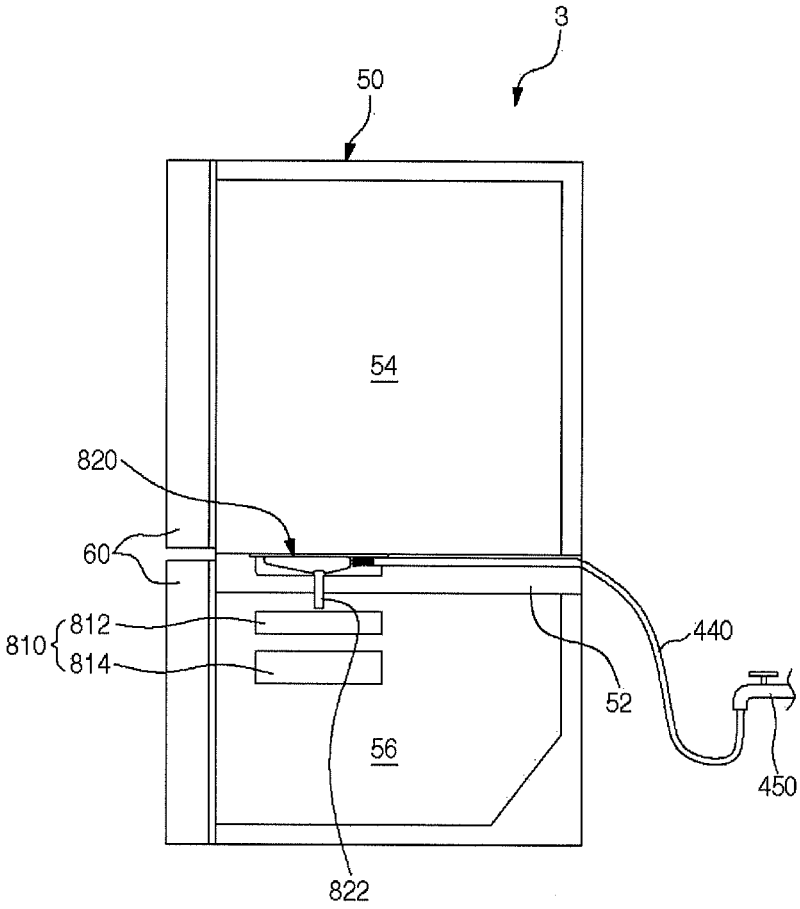
FIG. 10 is a side-sectional view of a refrigerator according to another embodiment.

FIG. 10 is a side-sectional view of a refrigerator according to another embodiment.

Referring to FIG. 10, a refrigerator 3 according to another embodiment includes a cabinet 50 defining a storage space and a door 60 for opening/closing the storage space. Here, an outer appearance of the refrigerator 2 is defined by the cabinet 50 and the door 60.

Also, the storage space inside the cabinet 50 is vertically partitioned by a barrier 52 to define a refrigerating compartment 54 at an upper side and a freezing compartment 56 at a lower side. The door 60 may include a refrigerating compartment door 60 for covering the refrigerating compartment 54 and a freezing compartment door 60 for covering the freezing compartment 56.

An ice making apparatus 810 is disposed inside the freezing compartment 56. The ice making apparatus 810 may be disposed under the barrier 52 or mounted on the barrier 52. The ice maker 810 may include the ice tray 812 for making ices and a basket 814 for storing the ices made in the ice tray 812.

A water supply unit 820 may be disposed on the barrier 52 above the ice making apparatus 810. The water supply unit 820 is connected to a water supply passage 440 to receive water for making ices from a water supply source 450. The water supply unit 820 has the same structure as that of the water supply unit 400 according to the foregoing embodiments.

The water supply unit 820 is seated upward on the barrier 5. A guide tube 822 passes through the barrier to vertically extend upward form the ice tray 812, thereby supplying water for making ices.

The water supply passage 440 connected to the water supply unit 820 is guided inside the barrier 52 on a rear surface of the cabinet 50. Then, the water supply passage 440 may be guided along the inside of the barrier 52 and connected to the water supply unit 820.

As necessary, the water supply unit 820 may be disposed under the freezing compartment 56 and fixedly mounted on a bottom surface of the barrier 52.

A refrigerator according to various other embodiments may be exemplified. Hereinafter, a refrigerator according to another embodiment will be described.

In the refrigerator according to another embodiment, water within a detachable water tank is supplied into an ice making apparatus through a water supply unit.

Figure 11:
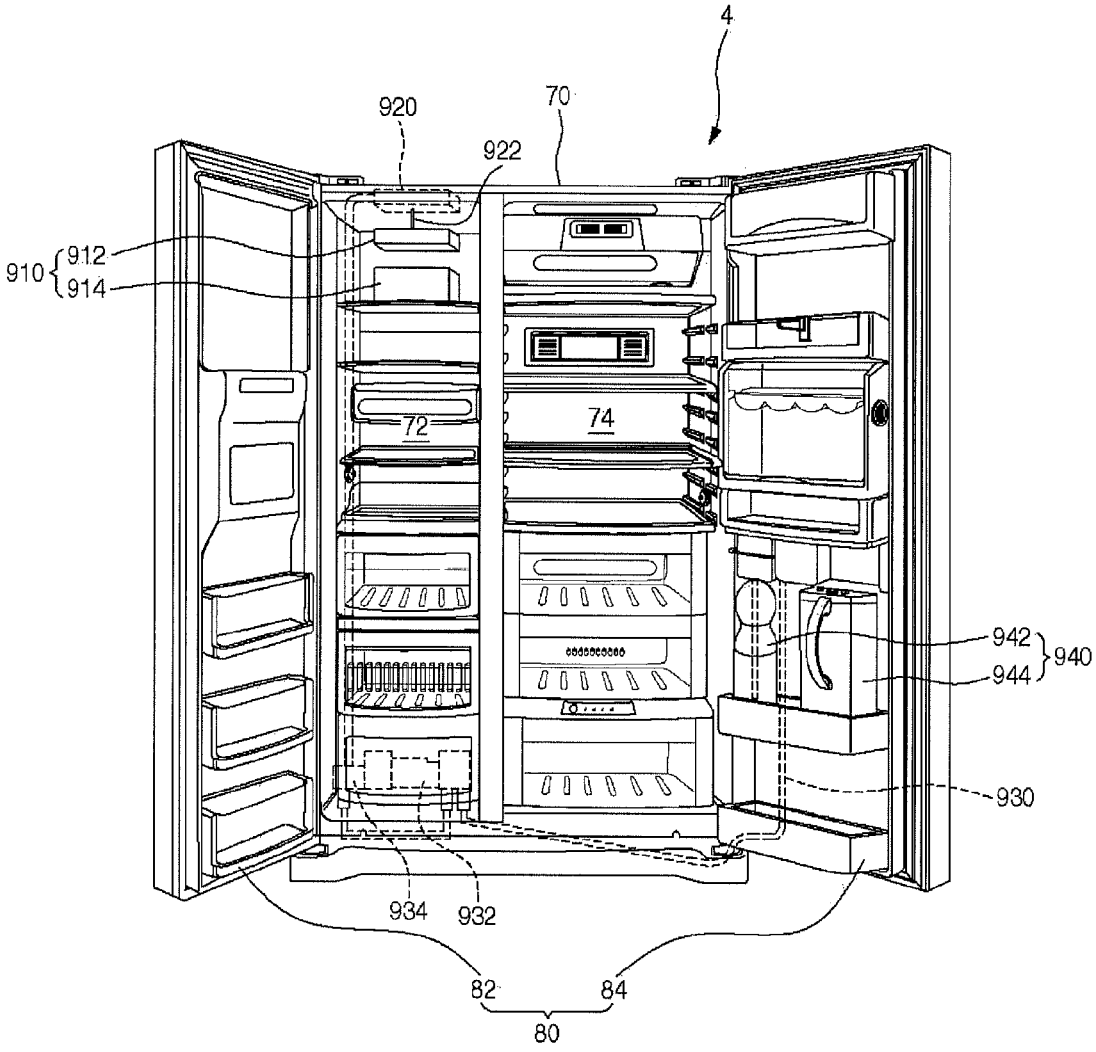
FIG. 11 is a view of a refrigerator with a door opened according to another embodiment.

FIG. 11 is a view of a refrigerator with a door opened according to another embodiment.

Referring to FIG. 11, a refrigerator 4 according to another embodiment includes a cabinet partitioned into left and right sides to define a freezing compartment 72 and a refrigerating compartment 74 and a door including a freezing compartment door 82 and a refrigerating compartment door 84 which respectively cover the freezing compartment 72 and the freezing compartment 74.

An ice making apparatus 910 for making ices is disposed at an upper side of the freezing compartment 72. The ice making apparatus 910 may include an ice tray 912 for making ices and an ice bank 914 for storing the made ices. The ices stored in the ice bank 914 may be dispensed to the outside through a dispenser (not shown) of the freezing compartment door 82.

A water supply unit 920 is disposed above the ice making apparatus 910. The water supply unit 920 is mounted on an outer upper side of the cabinet 70. The water supply unit 920 may supply water into the ice making apparatus 910 through a guide tube 922 passing through the cabinet 70. Also, the water supply unit 920 is connected to a water supply passage 930 connected to a water supply source 940.

The water supply source 940 constituted as a detachable water tank is disposed on the refrigerating compartment door 84. The water supply source 940 may be a plastic bottle 942. Alternatively, the water supply source 940 may be a water tank 944 which is detachably designed. The water supply source 940 may be disposed inside the refrigerating compartment 74, but the refrigerating compartment door 84.

The water supply passage 930 is disposed via the outside of the cabinet 70. As necessary, the water supply passage 930 may be disposed inside the cabinet 70. A pump 932 and a valve 934 for stably supplying water into the water supply passage 930 may be disposed on the water supply passage 930.

According to the embodiments, the water supplied from the water supply source is supplied into the water supply unit through the water supply unit. The water introduced into the water supply unit is supplied into the ice making apparatus in a state where the pressure and flow rate of the water are adjusted while flowing inside the water supply unit.

Thus, it may prevent the water supplied into the ice making apparatus from being spattered or overflowing due to a high pressure. In addition, it may prevent the stored ices from being tangled with each other or deteriorated when the ices are made.

Also, since the water supply unit is disposed vertically above the ice making apparatus to supply the water, the water spattering phenomenon may be minimized to further stably supply the water at the more stable position.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space which is opened or closed by a door;

an ice making apparatus disposed inside the storage space;

a water supply passage extending along the cabinet from a water supply source; and a water supply unit disposed above the ice making apparatus, wherein the water supply unit comprises:

a fill tank defining a space into which water supplied through the water supply passage is introduced, the fill tank being configured to have a sectional area greater than a sectional area of the water supply passage;

a connection tube connected to an outlet end of the water supply passage to introduce water from the water supply source into the fill tank, the connection tube being located at a position proximate to an edge at which adjacent side walls of the fill tank are connected in order to reduce pressure of the water from the water supply source by causing the water to rotate and swirl along an inner surface of the fill tank;

a case body installed in a recess located at an upper surface of the cabinet and having a space to receive the fill tank;

a case cover configured to open or close opened top surfaces of the case body and the fill tank; and a guide tube disposed on a bottom surface of the fill tank to extend downward so that the water in the fill tank is supplied into the ice making apparatus after rotating and swirling along the inner surface of the fill tank, wherein the bottom surface of the fill tank is declined from a peripheral portion of the fill tank toward a water discharge hole corresponding to an upper end of the guide tube.

2. The refrigerator according to claim 1, wherein side and bottom surfaces of the case body are buried into an insulation material filled into the cabinet.

3. The refrigerator according to claim 1, wherein the opened top surfaces of the case body and the fill tank are exposed to an outside of the cabinet when the case cover is removed.

4. The refrigerator according to claim 1, wherein at least a portion of the inner surface of the fill tank is curved or rounded so that the supplied water through the connection tube rotates to swirl before being supplied to the ice making apparatus.

5. The refrigerator according to claim 1, wherein the sectional area of the fill tank is configured to be greater than a sectional area of the guide tube.

6. The refrigerator according to claim 5, wherein the sectional area of the guide tube is configured to be greater than the sectional area of the water supply passage.

7. The refrigerator according to claim 1, wherein the bottom surface of the fill tank is inclined at an angle that is less than forty-five degrees relative to an uppermost wall of the cabinet.

8. The refrigerator according to claim 1, wherein the discharge hole is located at a central position of the bottom surface of the fill tank and the bottom surface of the fill tank is downwardly declined toward the discharge hole on all sides of the discharge hole.

9. The refrigerator according to claim 1, wherein the adjacent side walls of the fill tank include:

a first side wall at which the connection tube is disposed; and a second side wall facing the first side wall, wherein the discharge hole is located closer to the first side wall than the second side wall.

* * * * *